United States Patent [19]

Ishihara et al.

[11] Patent Number: 4,503,794

[45] Date of Patent: Mar. 12, 1985

[54] UPPER FEED DOG AUTOMATIC REGULATOR FOR OVERLOCK MACHINE

[75] Inventors: Keiichi Ishihara, Kawanishi; Fumio Matsumoto, Takatsuki, both of Japan

[73] Assignee: Yamato Mishin Seizo Kabushi Kaisha, Osaka, Japan

[21] Appl. No.: 531,470

[22] Filed: Sep. 12, 1983

[30] Foreign Application Priority Data

| | | | |
|---|---|---|---|
| Sep. 16, 1982 | [JP] | Japan | 57-161826 |
| May 17, 1983 | [JP] | Japan | 58-86042 |
| May 17, 1983 | [JP] | Japan | 58-86043 |

[51] Int. Cl.[3] ..... D05B 27/08

[52] U.S. Cl. ..... 112/313; 112/320

[58] Field of Search ..... 112/311, 312, 313, 320, 112/162, 122

[56] References Cited

U.S. PATENT DOCUMENTS

| | | | |
|---|---|---|---|
| 3,326,157 | 6/1967 | Hayes et al. | 112/313 |
| 3,450,079 | 6/1969 | Lukin | 112/313 |
| 3,611,817 | 10/1971 | Smith | 112/313 |
| 4,140,070 | 2/1979 | Travaglini | 112/313 |

*Primary Examiner*—Werner H. Schroeder
*Assistant Examiner*—Andrew M. Falik
*Attorney, Agent, or Firm*—Wenderoth, Lind & Ponack

[57] ABSTRACT

An upper feed dog automatic regulator for an overlock machine has an upper feed dog divided into a front part and a rear part. The greatest lower bound in a locus of motion of the upper feed dog varies automatically in response to the thickness of fabric being sewn so as to avoid uneven material feed, puckering between the front and rear upper feed dogs, and other sewing troubles.

5 Claims, 5 Drawing Figures

UPPER FEED DOG AUTOMATIC REGULATOR FOR OVERLOCK MACHINE

BACKGROUND OF THE INVENTION

1. Field of the Invention

This invention relates to an upper feed dog automatic regulator for an overlock machine, more particularly, to an apparatus for the overlock machine having such mechanisms that the lowest limit of an elliptical locus drawn by the upper feed dog is predetermined to meet cloth to be sewn but the lowest limit is adjustable automatically according to the change of thickness of upper and lower cloths due to a stepped part, a protruding part, etc. The lengthwise feed of the feed dog is adjustable easily by moving a lever on an indicator. The upper feed dog is adjustable in height according to the thickness of cloth to be sewn. Both the presser foot and the feed dog can be lifted up by pedalling. The upper feed dog is divided into a front part and the rear part, as in a case of the lower feed dog, so that the lengthwise feed and lifting feed of both feed dogs are differentiated by a differential feeder. With such arrangement, uneven material feed puckering between the front and near upper feed dogs and other troubles can be prevented also, material cloth of different kind can be sewn together with a good result.

2. Description of the Prior Art

In the conventional overlock machine of this kind, the upper feed dog which moves along an elliptical locus in contact with the upper surface of an upper cloth is provided opposite to the lower feed dog for the purpose of preventing uneven material feeding and other sewing troubles. This arrangement causes no trouble in sewing a plain portion of cloth but has such disadvantage in the case where a stepped part, a protruding part, or the like exists in upper and lower cloths. While both the lower feed dog and the upper feed dog are moving along the respective elliptical locus, the distance between the least upper bound and the greatest lower bound for a plain portion causes partially an abnormal pressure on the cloth, with the result of causing a bad sewing effect.

SUMMARY AND OBJECTS OF THE INVENTION

An object of the present invention is to provide such a device which, even where nonplanar portions, such as a stepped part or a protruding part, exist in cloth, copes with and treats automatically such abnormal portions of cloth, without the need of manual operation and skill.

Another object of the present invention is to provide a device to regulate the lengthwise feed of the upper feed dog.

Still another object of the present invention is to provide a device to regulate the degree of height of the upper feed dog.

Yet another object of the present invention is to provide a device to regulate the degree of pressure of the upper feed dog and to predetermine the greatest lower bound of the upper feed dog.

A further object of the present invention is to provide a device to push up the upper feed dog, together with the presser foot, for facilitating the operations of setting cloth on the machine and removing cloth from the machine.

A still further object of the present invention is to provide a downward pressure device which makes only slight resistance to the lengthwise feed of the upper feed dog.

An additional purpose of the present invention is to provide a device whereby expansion and contraction of cloth can be adjusted between the front and rear feed dogs.

The nature and advantages of the present invention will be understood more clearly from the following description made with reference to the accompanying drawings.

DETAILED DESCRIPTION OF THE PREFERRED EMBODIMENTS

Embodiment 1

Figure 4:
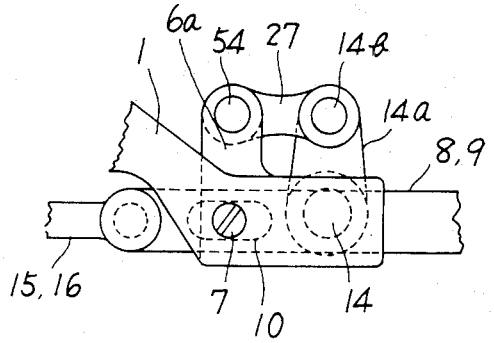
FIG. 4 is a side view of the upper feed dog bar sliding guide.

An upper feeder holder 1 is fitted rotatably, at its intermediate part, to a machine frame by an axis 2. An upper feeder pressure bar spring 3 is so arranged that it presses down the base end of an upper feed dog bar sliding guide 6 and is adjustable in its pressing down force by an upper feeder pressure bar spring regulating screw 4 which is threaded in the machine frame. An upper feed dog lowest limit position regulating screw 5 is threaded in the rear end portion of said upper feeder holder 1. The forward end of said regulating screw 5 is in contact with the machine frame and determines the greatest lower bound of the upper feed dog. An upper feed dog bar sliding guide 6 is fixed rotatably by an axial center 7 at the forward end of the upper feeder holder 1, through a slot 10 (FIG. 4 only) for an upper rear feed dog bar 8 and an upper front feed bar 9. This sliding guide 6 has a longitudinal through-hole 11 of square-shape in cross section. An upper rear feed dog 12 and an upper front feed dog 13 are fitted to the forward end of the upper rear feed dog bar 8 and the upper front feed dog bar 9, respectively. These bars 8 and 9 are slidable in said through-hole 11. Numeral 14 designates an upper feed dog vertical rocking axis. Numeral 15 designates an upper rear feed connecting rod and numeral 16 designates an upper front feed connecting rod. The rods 15 and 16 are connected to the base ends of the upper rear feed dog bar 8 and the upper front feed dog bar 9, respectively. A main shaft 17 fixes an eccentric wheel 18. To a connecting rod outer ring 19*a* of said eccentric wheel 18, there is connected the base end of an upper knife driving shaft connecting rod 19 which reciprocates in response to the rotation of the eccentric wheel 18. A rocking rod 20 has its base end connected to the forward end of the upper knife driving shaft connecting rod 19 and rocks in response to the reciprocation of said connecting rod 19. An upper knife driving shaft 21 has both ends 22 fitted rotatably to the machine frame. The forward end of said rocking rod 20 is connected to the upper knife driving shaft 21 which is moved axially by the rocking of the rocking rod 20. An upper feed dog vertical rocking arm 23 has its base end connected to the upper knife driving shaft 21. The rocking arm 23 has its forward end bent at a right angle and fitted rotatably at one end of a vertical rocking connecting rod 24, the other end of which is fitted rotatably to a pin for a lifting feed regulating screw 25. The upper feed dog vertical rocking axis 14 is fitted rotatably, at its both end portions, to the machine frame. An arm 14*a* is formed by bending a right angle the forward end portion of said upper feed dog vertical rocking axis 14. The base end of a vertical rocking link 27 is fitted rotatably to the forward end of the right-angled bent arm 14*a* of vertical rocking axis 14. A sliding guide projecting part 6*a* has its base end fitted axially to the forward end of the vertical rocking link 27. The forward end of the projecting part 6*a* is connected to the upper feed dog bar sliding guide 6. A lifting feeder for upper front feed dog 28 is composed by the above-mentioned arrangements ranging from the eccentric wheel 18 to the projecting part 6*a*. A lengthwise feeder for upper feed dog 29, whose base end starts at the outer ring 19*a* of the eccentric wheel 18 and whose forward end is connected to the upper rear feed connecting rod 15 and the upper front feed connecting rod 16, is provided separately.

Figure 3:
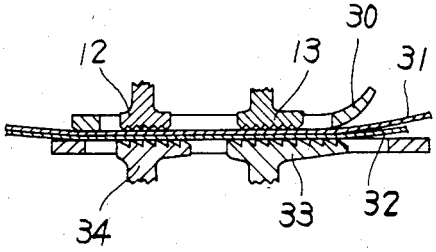
FIG. 3 is a vertical section of the portion of upper and lower feed dogs, each divided into front parts and rear parts, in sewing operation.

This embodiment is composed as mentioned above. By the combined action of both the lifting feeder and the lengthwise feeder, lifting and lengthwise motion is given to the upper rear feed dog bar 8 and the upper front feed dog bar 9, whereby the upper rear feed dog 12 and the upper front feed dog 13, which are fixed to the top ends of the upper rear feed dog bar 8 and the upper front feed dog bar 9, respectively, move through the upper feeding motion of an elliptical locus. However, if it is so designed that the greatest lower bound of the upper feed and the minimum upper bound of the lower feed are constant, there is caused no trouble so long as plain portions of upper and lower cloths are sewn together. But, trouble will be caused when there is sewing of a stepped part, a protruding part, etc., if any, due to the difference in thickness of cloth. With this problem in view, in this embodiment, the sliding guide 6 is connected to the upper feeder holder 1 and flexibility is given to the minimum lower bound of the upper feed dog by the spring 3 and that such flexibility is made adjustable by the operation of the regulating screw 4. Therefore, even if a stepped part, a protruding part, etc., are present in cloth being sewn, such elasticity can meet the change of thickness of cloth with the result of a good sewing effect. In the drawings, numeral 30 designates a presser foot, numeral 31 (FIG. 3 only) designates an upper cloth, numeral 32 (FIG. 3 only) designates a lower cloth, numeral 33 designates a lower front feed dog and numeral 34 designates a lower rear feed dog. These parts are already known in the field of sewing machines of this kind.

Embodiment 2

A lower feed dog lengthwise feed shaft 35 is provided conventionally for the overlock machine. An arcuate lifting feed regulating arm 36 carrying an arcuate portion 36*a* at its forward end has its base end portion fitted in the shaft 36. A slider 37 is slidably put on the arcuate portion 36*a* of the regulating arm 36. The slider 37 is provided with axes 37*a*, 37*b* at both sides thereof. An upper feed dog lengthwise feed shaft 38 has a rocking rod 39 fixed to the base end portion thereof. The forward end of the rocking rod 39 and the axis 37*b* at one side of the slider 37 are connected rotatably by a lengthwise rocking connecting rod 40. Thus, the lengthwise feed shaft 38 has rocking rotation motion. A sleeve 41 has the upper feed dog lengthwise feed shaft 38 fitted rotatably therein. An arm rod 42 drives the slider 37, with its base end fitted in the base end portion of the sleeve 41 and with its forward end forked in two portions 42*a*. A slide block 43 is rotatably supported by the axis 37*a* at the other side of the slider 37 and is fitted slidably in the forked portion 42*a*. A lever 44 is fixed to a forward end portion 41*a* of the sleeve 41. This lever 44 is movable on an indicator 45 but is fixable at the desired point on the indicator 45. A rear upper feed dog lengthwise feed arm 47 has its base end portion fitted in the forward end of the upper feed dog lengthwise feed shaft 38. The upper feeder holder 1 comprises the upper rear feed dog bar 8 and the upper front feed dog bar 9, both fitted slidably in the upper feed dog bar sliding guide 6. The upper rear feed connecting rod 15 connects the feed arm 47 and the base portion of the upper rear feed dog bar 8 and the upper front feed dog bar 9 of the upper feeder holder 1.

The upper rear feed dog 12 and the upper front feed dog 13 are both being provided at forward end portions of the upper rear feed dog bar 8 and the upper front feed dog bar 9, respectively.

Figure 2:
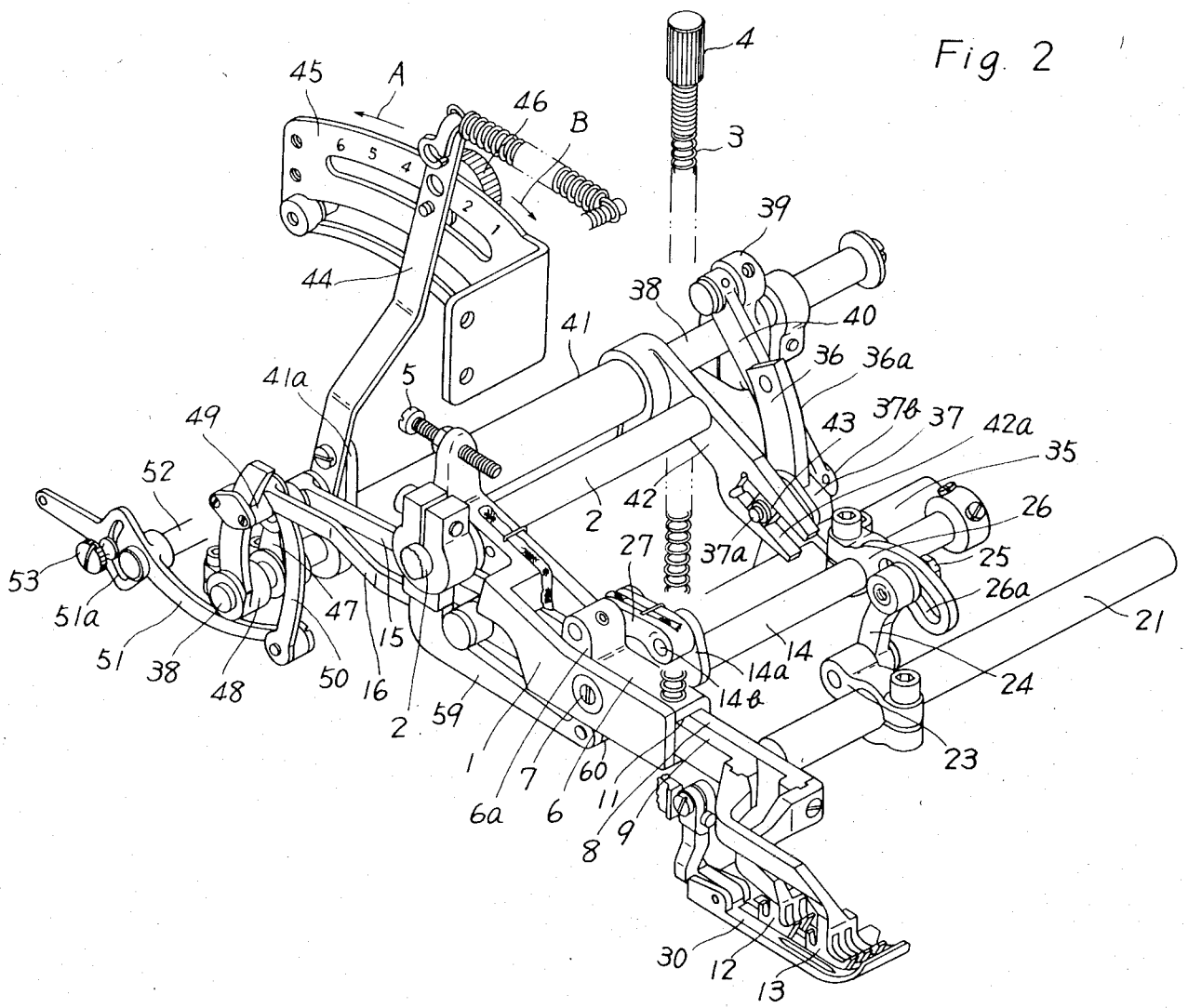
FIG. 2 is a perspective view of a main part of the present invention.

This embodiment is composed as mentioned above. In using the device of this embodiment, if the regulating screw 46 is loosened and the lever 44 is moved on the indicator 45, the sleeve 41 whose forward end portion 41*a* is fixed turns round the upper feed dog lengthwise feed shaft 38 with the movement of the lever 44. Thus, the rod arm 42 fixed to the base end of the sleeve 41 is actuated, whereby the slider 37 moves toward the forward end of the arcuate portion 36*a* of the arcuate lifting feed regulating arm 36, through the medium of the forked portion 42*a* of the arm rod 42 and the slide block 43. In FIG. 2, if the lever 44 moves in the direction of arrow A, the slider 37 moves toward the forward end of the arcuate portion 36*a* of the regulating arm 36 and the constant rocking rotating force of the lower feed dog lengthwise feed shaft 35 is transmitted to the slider 37 in a magnified quantity. Such a magnified rocking rotating force is transmitted to the upper feed dog lengthwise feed axis 38 through the medium of the rocking connecting rod 40 and the rocking rod 39. Such magnified force is transmitted into a lengthwise rocking quantity through the medium of the upper rear feed connecting rod 15 and the upper feeder holder 1. Thus, the lengthwise rocking quantity of the upper rear feed dog 12 is enlarged. On the contrary, if the lever 44 moves in the direction of arrow B, the slider 37 moves toward the base end of the arcuate portion 36*a* and the constant rocking and rotating quantity force of the shaft 35 is transmitted to the slider 37 in a reduced quantity. Therefore, such reduced rocking rotating quantity is converted into the lengthwise rocking quantity. Thus, the lengthwise rocking quantity of the upper rear feed dog 12 is lessened.

Embodiment 3

Figure 1:
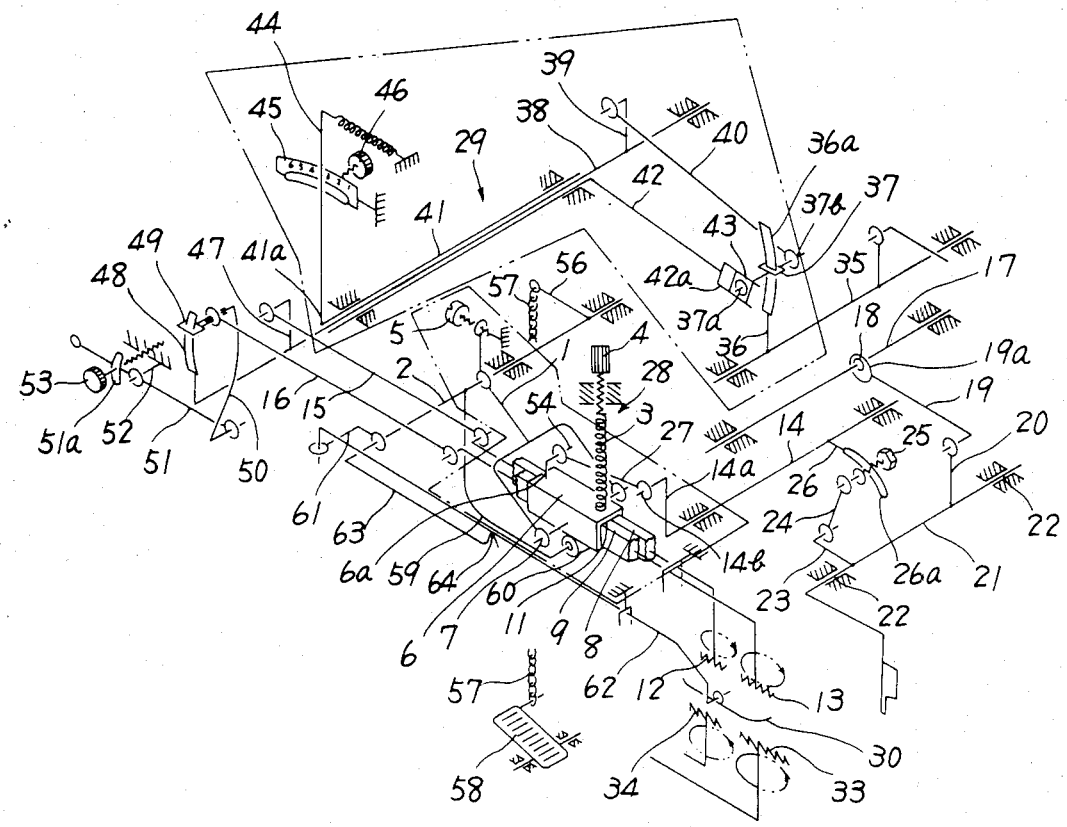
FIG. 1 is a perspective view of the whole mechanism of the present invention.

Returning to FIG. 1, an upper knife driving shaft 21 is shown in the overlock machine. This shaft 21 is fitted rotatably to the machine frame and does the rocking rotating motion. An upper feed dog vertical rocking arm 23 has its base end portion fixed to the shaft 21. An upper feed dog vertical rocking axis 14 carrying at its forward end an arm of vertical rocking axis 14*a* with a pin 14*b* at the forward end thereof is fitted rotatably to the machine frame, in the vicinity of the upper knife driving shaft 21 and in parallel with the machine frame.

An arcuate vertical momentum regulating arm 26, carrying an arcuate slot portion 26*a* at the forward end thereof, has its base portion fixed to the intermediate portion of the upper feed dog vertical rocking axis 14. A vertical rocking connecting rod 24 has its base end portion fitted rotatably to the forward end of the vertical rocking arm 23. Rod 24 also has its forward end portion fixed rotatably to a proper portion of an arcuate slot portion 26*a* of the regulating arm 26 by a pin for lifting feed regulating screw 25. If the forward end portion of the connecting rod 24 is fixed to the base end portion of the arcuate slot portion 26*a* of the regulating arm 26, the fixed rocking force quantity of the upper knife driving shaft 21 is transmitted to the upper feed dog vertical rocking axis 14 in a magnified quantity but if the forward end portion of the connecting rod 24 is fixed to the forward end portion of the arcuate slot portion 26*a*, the rocking force quantity of the upper knife driving shaft 21 is transmitted to the rocking axis 14 in a reduced quantity. An arcuate regulating device is composed of the regulating arm 26 having the arcuate slot portion 26*a*, the connecting rod 24, the pin for lifting feed regulating screw 25, etc. A vertical rocking link 27 has its base end portion fitted in the pin 14*b* at the arm of vertical rocking axis of the rocking axis 14*a* and its forward end is fitted rotatably to the upper feed dog sliding guide 6 by a connecting pin 54. The upper feeder holder 1 has its forward end portion forked into two portions and its base end portion supported rotatably by the axis of upper feeder holder 2. The sliding guide 6 is rotatably supported at the forked portion of the upper feeder holder 1 by the axial center 7. Thus, the lifting feeder for upper front feed dog 28, which converts the lengthwise rocking motion of the vertical rocking link 27 into vertical motion with the axial center 7 as its center, is composed from the above-mentioned elements. The upper rear feed dog and the upper front feed dog 13 are fixed to the upper rear feed dog bar 8 and the upper front feed dog bar 9, respectively. These upper feed dogs 12 and 13 go up and down in a groove made in the presser foot 30, such motion being caused by the lifting feeder for upper feed dog 28.

This embodiment is composed as mentioned above. In regulating the degree of going up and down of the upper rear feed dog 12 and the upper front feed dog 13, the pin for lifting feed regulating screw 25 is loosened and the forward end fixing portion of the link 27 is moved properly either toward the base end or toward the forward end portion of the arcuate slot portion 26*a* of the regulating arm 26. By fixing again the forward end fixing portion of the link 27 by the pin 25, the fixed rotating and rocking motion of the upper knife driving shaft 21 is transmitted to the upper feed dog vertical rocking axis 14 in a varied quantity and such rotating motion is converted into linear rocking motion of the link 27 in the lenghwise direction, through the medium of the arm of vertical rocking axis 14*a* and the pin 14*b*. Such linear rocking motion of the link 27 is transmitted to the upper feeder holder 1 through the medium of the sliding guide 6. The upper feeder holder 1, together with the sliding guide 6, converts the linear rocking motion into motion in the vertical direction. Thus, the optimum rocking force quantity (degree of going up and down) of the upper rear feed dog 12 and the upper front feed dog 13 can be regulated according to the thickness of cloth to be sewn.

Embodiment 4

A conventional presser foot lifting arm 56 has its base portion fixed to the axis of upper feeder holder 2 and its forward end connected to a pedal 58 via a chain 57. A lifting arm 59 is composed of a L-shape member. The base portion of the lifting arm 59 is fixed to the axis of upper feeder holder 2. A roller 60 is rotatably supported by an axis at the forward end of the lifting arm 59 and rotates in contact with the under surface of the sliding guide 6. A conventional hinge 61 is rotatably supported by the forward end portion of the axis of upper feeder holder 2. The base end portion of a conventional presser foot holder 62 carrying a presser foot 30 at its forward end is fixed by the hinge 61, whereby the up and down motion of the presser foot 30 is made possible. A conventional presser foot pushing up arm 63 has its base end portion fixed to the forward end of the axis of upper feeder holder 2. By a projection 64 formed at the forward end of the pushing up arm 63, the under surface of another projection formed at the presser foot holder 62 is pushed up with the rotation of the axis of upper feeder holder 2, whereby the presser foot 30 goes up and down. The upper rear feed dog 12 and the upper front feed dog 13 are fixed to the forward end of the upper rear feed dog bar 8 and the upper front feed dog bar 9, respectively.

Figure 5:
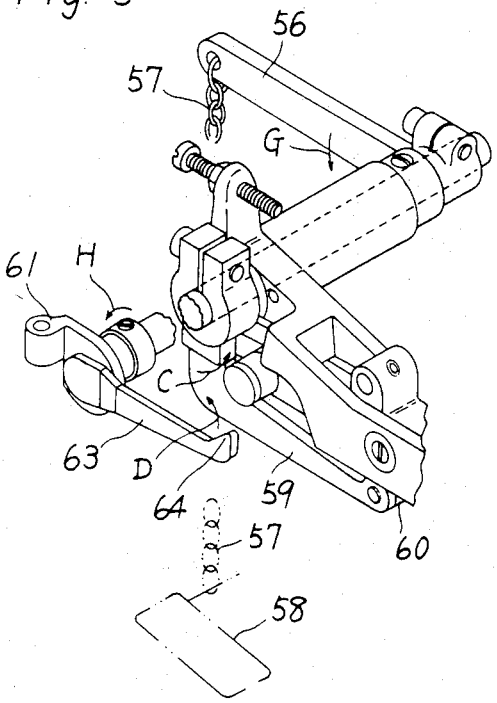
FIG. 5 is a perspective view of a main part of Embodiment 4.

This embodiment is composed as mentioned above. If a pedal 58 (FIG. 5) is pressed at the start or at the finish of a sewing operation, the presser foot lifting arm 56 turns in the direction of arrow G in FIG. 5 and the axis of upper feeder holder 2 (not shown in FIG. 5) turns in the direction of arrow H, whereby the lifting arm 59 and the presser foot pushing up arm 63 turn in the direction of arrow C and arrow D, respectively. Returning to FIG. 1, the roller 60 at the top end of the lifting arm 59 pushes up the sliding guide 6 of the lifting feeder for the upper front feed dog 28 and also pushes up the upper rear feed dog 12 and the upper front feed dog 13, together with the upper rear feed dog bar 8 and the upper front feed dog bar 9. At the same time, a projection 64 at the forward end of the presser foot pushing up arm 63 pushes up the presser foot holder 62 and the presser foot 30. If an operator's foot is kept from a pedal 58, the presser foot lifting arm 59 turns in the direction contrary to arrow C (FIG.5) and the axis of upper feeder holder 2 also turns in the direction contrary to arrow B (FIG. 2). Furthermore, the lifting arm 59 and the pushing up arm 63 turn in the contrary direction and the roller 60 at the top end of the lifting arm 59 turns in the contrary direction, whereupon the upper rear feed dog 12 and the upper front feed dog 13 are lowered through the medium of the lifting feeder for the upper front feed dog 28. At the same time the presser foot 30 is also lowered.

Embodiment 5

The upper feeder holder 1 has its base portion supported rotatably by an axis. The sliding guide 6 has a square-tube shape and is supported at the forward end of the upper feeder holder 1 by an axial center 7. The upper rear feed dog bar 8 and the upper front feed dog bar 9 are inserted slidably the lengthwise direction in the sliding guide 6. The upper feeder pressure bar spring 3 is embedded in the machine frame in such a fashion that its forward end presses the upper surface of the sliding guide 6. Its base end is a spring regulating screw 4 which can adjust elastic pressure of the bar spring 3.

This embodiment is composed as mentioned above. By regulating the adjusting screw 4 in accordance with cloth to be sewn, the bar spring 3 can easily determine the optimum pressing quantity on the upper rear feed dog 12 and the upper front feed dog 13. When cloth has thicker or thinner portions, the sliding guide 6 expands or contracts in conformity to the thickness of cloth and therefore can press properly the upper rear feed dog 12 and the upper front feed dog 13, with the result being a good sewing effect.

Embodiment 6

Numeral 35 designates a conventional lower feed dog lengthwise feed shaft. The arcuate lifting feed regulating arm 36 carries an arcuate portion 36*a* at its top end portion and has its base end portion fixed to the shaft 35. The slider 37 is fitted slidably to the arcuate portion 36*a* of the arm 36 and carries at its both sides the axes 37*a*, 37*b*. The upper feed dog lengthwise feed shaft 38 has the rocking rod 39 fixed to its base end portion. The forward end of the rocking rod 39 and the axis 37*b* at one side of the slider 37 are connected rotatably by the lengthwise rocking connecting rod 40. This shaft 38 does rocking rotating motion, together with the axis 35. The sleeve 41 has the upper feed dog lengthwise feed shaft 38 fitted rotatably therein. The arm rod 42 drives the slider 37, with its base end fixed to the base end portion of the sleeve 41 with its top end forked into two portions 42*a*. The slide block 43 is supported rotatably by an axis on the other side of the slider 37 and is fitted slidably in the forked portion 42*a* of the arm rod 42. The lever 44 is fixed to the forward end portion 41*a* of the sleeve 41. This lever 44 moves on an indicator 45 fixed to the machine frame and is fixable at the desired portion on the indicator 45 by the lengthwise feed regulating screw 46 provided at the forward end portion thereof. The upper rear feed dog 12 and the upper front feed dog 13 are fitted to the upper rear feed dog bar 8 and the upper front feed dog bar 9, respectively. Connected to the upper rear feed dog bar 8 and the upper front feed dog bar 9, there are the upper rear feed connecting rod 15 and the upper front feed connecting rod 16 respectively, to which a slider 49 is connected. An upper front feed dog lengthwise feed regulating arm 48 passes through the slider 49 slidably. The regulating arm 48 is connected to the upper feed dog lengthwise feed shaft 38. The upper front feed connecting rod 16 is connected to a differential connecting rod 50, which is connected to a differential lever 51 and is further connected to a differential lever axis 52 by means of a differential lever fixing screw 53 which is fixable at the desired position in a fixing groove 51*a*. The upper rear feed dog 12 and the upper front feed dog 13 are fitted to the upper rear feed dog bar 8 and the upper front feed dog bar 9, respectively, which are fitted slidably in the sliding guide 6 a parallel state and are connected to the upper feed dog lengthwise feed shaft 38 via the upper rear feed connecting rod 15, the upper front feed connecting rod 16, and the rear upper feed dog lengthwise feed arm 47. Generally, a good sewing effect can be obtained by making the lifting rear lock motion larger and making the lifting front lock motion smaller in the case of fabric of slight elasticity. This is called reverse differential. In the case where fabrics of slight elasticity are treated by the overlock machine, puckering is liable to take place with resultant bad sewing. By the above-mentioned reverse differential, fabric between the front feed dog 13 and the rear feed dog 12 is stretched and puckering does not take place even on cloth of slight elasticity. Conventionally, only the lower feed dog was divided into the front part 33 and the rear part 34 for differential regulation but this was not quite satisfactory. In the present embodiment, the upper feed dog, (12, 13) like the lower feed dog (33, 34), is divided into the front part 13 and the rear part 12 and the differential regulation is effected. By this device, puckering has been eliminated perfectly. In the case of sewing the fabric of high elasticity such as knit, good sewing effect can be obtained by making the lifting rear lock motion smaller and making the lifting front lock motion larger. This is called normal differential. In overlock sewing of the fabric of large elasticity such as knit, it is difficult to sew fabric between the front feed dog 13 and the rear feed dog 12 and the fabric is stretched excessively, with the result of bad sewing.

Conventionally, only the lower feed dog (33, 34) is divided into the front part 33 and the rear part 34 and differential regulation is effected but this is not satisfactory. In the present embodiment, the upper feed dog (12, 13) is divided into the front part 13 and the rear part 12 and normal differential regulation is effected. Therefore, even knitted fabric is easily fed between the front feed dog 13 and the rear feed dog 12, with the result of a good sewing effect. The normal differential and the reverse differential can be obtained as desired by fixing the fixing screw 53 at the desired position in the curved fixing groove 51*a*, whereby the feed by the upper front feed dog 13 can be adjusted in relation to the constant feed by the upper rear feed dog 12.

The foregoing preferred embodiments are considered illustrative only. Thus, the disclosed invention is not limited to the exact constructions shown but is defined by the appended claims.

We claim:

1. An upper feed dog automatic regulator in an overlock machine for sewing a fabric having a variable thickness, said regulator comprising:

a machine frame;

an axis fixed rotatably in the machine frame;

an upper feed dog bar means for moving along an elliptical locus of motion lengthwise and vertically between an upper bound and a lower bound;

an upper feeder holder having an intermediate part fitted rotatably to the axis and also having a forward part;

a sliding guide means, fitted to the forward part of the upper feeder holder, for holding the upper feed dog bar means therein, said sliding guide means having a base end;

an upper feeder pressure bar spring means, connected to the base end of the sliding guide means, for pressing down said sliding guide means;

an upper feeder pressure bar spring regulating screw means, threaded in the machine frame, for adjusting the pressing down force of the spring means; and separate front and rear upper feed dogs fitted to the upper feed dog bar means;

whereby the lower bound in the elliptical locus of motion of the upper feed dog bar means varies automatically in response to the thickness of the fabric being sewn so as to avoid uneven material feed, puckering between the front and rear upper feed dogs, and other sewing trouble.

2. The automatic regulator, according to claim 8, further comprising:

a lower feed dog lengthwise feed shaft fixed to the machine frame;

an arcuate lifting feed regulating arm fixed to the lower feed shaft;

a slider movable on the regulating arm;

an arm rod means for driving the slider;

an upper feed dog lengthwise feed shaft fixed to the arm rod means;

a sleeve in which the upper feed shaft is rotatably fitted, said sleeve having a forward end portion;

a lever fixed to the forward end portion of the sleeve;

an indicator on which the lever is movable; and screws means, connected between the indicator and the lever, for regulating the lever;

whereby the transmission of rocking and rotating force between the lower and upper feed shafts may be regulated.

3. The automatic regulator, according to claim 8, further comprising:

an arcuate vertical momentum regulating arm carrying an arcuate slot portion;

an upper feed dog vertical rocking axis, fixed to the arcuate regulating arm and carrying an arm of a vertical rocking axis with a pin; and a vertical rocking link having a base end portion fitted in the pin at the arm of the vertical rocking axis and having a forward end fitted rotatably to the sliding guide means;

whereby lengthwise rocking motion of the vertical rocking link is converted into vertical motion for the sliding guide means, the upper feed dog bar means, and the upper feed dogs.

4. The automatic regulator, according to claim 8, further comprising:

a pedal;

a chain having two ends and being connected at one of the two ends to the pedal; and a presser foot lifting arm being connected at its forward portion to the other of the two ends of the chain and being connected at its base portion to the axis fitted rotatably in the machine frame;

whereby pressing of the pedal causes the upper feeder holder, the sliding guide means, the upper feed dog bar means, and the upper feed dogs to move upwardly.

5. The automatic regulator, according to claim 8, further comprising:

an upper front and rear feed connecting rods being connected at one end to the upper feed dog bar means;

a rear upper feed dog lengthwise feed arm having two ends and being connected at one end to the upper rear feed connecting rod;

an upper feed dog lengthwise feed shaft being connected to the other end of the feed arm;

an upper front feed dog lengthwise feed regulating arm connected to the feed shaft;

a slider means for slidably passing the feed regulating arm therethrough;

a differential connecting rod being connected to the upper front feed connecting rod at the slider means;

a differential lever having two ends and being connected at one end to the differential connecting rod;

a differential lever axis connected to the differential lever; and a differential lever screw means, attached to the machine frame, for fixing the differential lever about the differential lever axis at a desired position;

whereby, due to reverse differential, fabric between the front and rear upper feed dogs is stretched and puckering does not take place, even on fabric of slight elasticity.

* * * * *